US010634155B2

(12) United States Patent
Meuter

(10) Patent No.: US 10,634,155 B2
(45) Date of Patent: Apr. 28, 2020

(54) PUMP DRIVE UNIT FOR CONVEYING A PROCESS FLUID

(71) Applicant: Sulzer Management AG, Winterthur (CH)

(72) Inventor: Paul Meuter, Seuzach (CH)

(73) Assignee: SULZER MANAGEMENT AG, Winterthur (CH)

( * ) Notice: Subject to any disclaimer, the term of this patent is extended or adjusted under 35 U.S.C. 154(b) by 164 days.

(21) Appl. No.: 15/295,340

(22) Filed: Oct. 17, 2016

(65) Prior Publication Data

US 2017/0122324 A1 May 4, 2017

(30) Foreign Application Priority Data

Nov. 2, 2015 (EP) ..... 15192545

(51) Int. Cl.
*F04D 29/12* (2006.01)
*F04D 7/06* (2006.01)
(Continued)

(52) U.S. Cl.
CPC ..... *F04D 29/128* (2013.01); *F04D 7/06* (2013.01); *F04D 13/06* (2013.01);
(Continued)

(58) Field of Classification Search
CPC .... F04D 29/086; F04D 29/106; F04D 29/128; F04D 29/5806; F04D 29/5866;
(Continued)

(56) References Cited

U.S. PATENT DOCUMENTS 3,017,072 A * 1/1962 Hagg ..... F04D 7/06 310/61
3,600,101 A * 8/1971 Oglesby ..... F04D 7/06 277/358

(Continued)

FOREIGN PATENT DOCUMENTS

EP 2492511 A2 8/2012
JP 59-119099 * 7/1984
JP 2001173591 A 6/2001

OTHER PUBLICATIONS

International Search Report and Written Opinion dated Apr. 18, 2016 in European Patent Application No. 15192545.0, filed Nov. 2, 2015.

*Primary Examiner* — Charles G Freay
(74) *Attorney, Agent, or Firm* — Global IP Counselors, LLP

(57) ABSTRACT

A pump drive unit for conveying a process fluid includes a housing which surrounds a pump having an impeller, a drive for the pump, a shaft for driving the impeller which connects the drive to the pump, and a restrictor extending around the shaft and arranged between the impeller and the drive. The housing has a pump inlet and outlet for the process fluid, with an inlet for introduction of a barrier fluid into the drive and an outlet for draining the barrier fluid from the housing. A plurality of storage chambers for the barrier fluid are disposed at the shaft in the region between the restrictor and the drive. The storage chambers are arranged behind one another with respect to the axial direction, with a respective two adjacent storage chambers being in flow communication with one another.

18 Claims, 5 Drawing Sheets

(51) Int. Cl.

| | |
|---|---|
| ***F04D 29/10*** | (2006.01) |
| ***F04D 13/06*** | (2006.01) |
| ***F04D 29/58*** | (2006.01) |
| ***F04D 29/42*** | (2006.01) |

(52) U.S. Cl.
CPC ..... *F04D 13/0606* (2013.01); *F04D 29/106* (2013.01); *F04D 29/426* (2013.01); *F04D 29/5806* (2013.01)

(58) Field of Classification Search
CPC . F04D 29/426; F04D 7/02; F04D 7/06; F04D 13/06; F04D 13/063; F04D 13/16
USPC ..... 277/411, 412, 418–420; 417/367
See application file for complete search history.

(56) References Cited

U.S. PATENT DOCUMENTS

| | | | | | |
|---|---|---|---|---|---|
| 3,926,783 | A * | 12/1975 | Wolk | B01J 8/22 208/127 |
| 3,947,154 | A * | 3/1976 | Klepp | F04D 29/426 415/112 |
| 4,614,482 | A * | 9/1986 | Gaffal | F04D 13/062 417/367 |
| 6,436,279 | B1 * | 8/2002 | Colyar | C10G 45/16 208/107 |
| 9,593,684 | B2 * | 3/2017 | Shargots | F04D 7/08 |
| 2010/0272560 | A1 * | 10/2010 | Buell | F04D 7/06 415/180 |
| 2014/0105765 | A1 * | 4/2014 | Tonnessen | F04D 25/0686 417/372 |

* cited by examiner

PUMP DRIVE UNIT FOR CONVEYING A PROCESS FLUID

CROSS-REFERENCE TO RELATED APPLICATIONS

This application claims benefit to European Application No. 15192545.0, filed Nov. 2, 2015, the contents of which is hereby incorporated herein by reference.

BACKGROUND

Field of the Invention

The invention relates to a pump drive unit for conveying a process fluid as described herein.

Background of the Invention

Pump drive units in which a pump having an impeller and a drive for the pump are surrounded by a common housing are frequently used for applications in which the pump is entirely or completely immersed in a liquid, e.g. water, or when the pump is operated at locations with difficult access or under difficult conditions or environmental conditions.

One application example for this is represented by pumps which are used for fluidized bed processes or ebullated bed processes in the hydrocarbon processing industry. These processes serve, for example, to purify heavy hydrocarbons, e.g. heavy fuel oil, or to purify refinery residues or to break them down into more easily usable, more highly volatile hydrocarbons. This is frequently done by applying hydrogen to the heavy hydrocarbons, wherein the mixed components are swirled in a reactor and the heavy hydrocarbons are there broken down with the aid of catalysts. To circulate the process fluid, which typically very largely comprises heavy hydrocarbons, in an ebullated bed reactor or fluidized bed reactor, special pump drive units are used for which the name ebullating pump has become common. These ebullating pumps are as a rule provided directly at the reactor as circulation pumps for the process fluid and are configured for process reasons such that the pump is arranged above the drive with respect to the vertical. Ebullating pumps have to work as reliably as possible and over a long time period in permanent operation under extremely challenging conditions.

SUMMARY

For the process fluid is typically at a very high pressure due to the process of, for example, 200 bar or more and has a very high temperature of more than 400° C., e.g. 460° C. The housing of such pump drive units is therefore designed as a pressure housing which can withstand these high operating pressures. The drive is typically designed as an electric motor which is likewise exposed to the high operating pressure within the housing. The motor has to be sufficiently protected against the penetration of process fluid so that the motor is typically filled with a barrier fluid or has such a barrier fluid flow therethrough, which additionally serves as lubrication and for heat dissipation from the motor. In this respect, it is possible to have embodiments that are completely oil-filed motors or as canned motors or as so-called cable-wound motors.

With completely oil-filled motors, both the rotor and the stator are completely surrounded by or immersed in the barrier liquid. The barrier fluid for this embodiment therefore has to be a dielectric fluid, e.g. a dielectric oil, to avoid a short-circuit in the motor.

With the canned motor, a can is disposed between the stator and the rotor and hermetically closes the stator with respect to the rotor, with the rotor typically also being protected by a jacket. In the embodiment as a canned motor, the barrier fluid is typically conducted through the gap between the rotor and the can.

With the cable-wound motor, the electrical lines with which the stator winding is wound is surrounded by an electrically insulating jacket.

Since a short-circuit caused by the barrier fluid is not possible in the canned motor and in the cable-wound motor, a different barrier fluid than a dielectric fluid can also be used in these embodiments. This is inter alia also advantageous for many applications for the reason that a barrier fluid having cooling and lubrication possibilities which are as ideal as possible can be selected without taking its electrical conductivity properties into account.

Embodiments are also known in which the process fluid itself is used as the barrier fluid for cooling and lubricating the motor; however, it is essential for many applications that the motor is sufficiently protected against a penetration of the process fluid. Heavy hydrocarbons as a process fluid, which are left over as residues in the distillation of petroleum, thus very frequently contain chemically aggressive and/or abrasive substances so that the process fluid can in particular produce substantial damage in the drive or also in the bearings.

It is thus an important function of the barrier fluid, in addition to the lubrication and cooling, to protect the drive of the pump sufficiently against the penetration of process fluid.

The barrier fluid is in this respect very frequently conducted in a cooling circuit. The barrier fluid is introduced into the drive through an inlet, flows through the drive, for example through the gap between the rotor and the can, and the radial bearing of the shaft at the pump side and is then drained through an outlet in the region between the drive and the pump. The barrier fluid flows from this outlet via a heat exchanger back to the inlet. To ensure the circulation of the barrier fluid in the cooling circuit, it is known to provide an auxiliary impeller at the side of the drive remote from the pump, with said auxiliary impeller being set into rotation by the shaft driven by the motor and thereby effecting the circulation of the barrier fluid in the cooling circuit.

An injection apparatus for the refilling of barrier fluid is frequently additionally provided by which additional barrier fluid can be introduced either into the cooling circuit outside the housing or directly into the drive through a separate inlet opening. This additional introduction of barrier fluid primarily serves to compensate for losses which arise in that a typically negligible flow rate of the barrier fluid into the process fluid is provided. When the barrier fluid flowing out of the drive flows along the shaft, the barrier fluid is not drained completely through the outlet, but some of it flows or creeps along the shaft into the pump and mixes with the process fluid there. This process is intentional and desirable since due to this flowing of the barrier fluid into the pump it can be reliably avoided that, conversely, process fluid flows from the pump along the shaft in the direction of the drive or penetrates into the drive. The barrier fluid therefore blocks the reverse path for the process fluid from the pump into the drive by the flowing into the pump.

To limit the flow of the barrier fluid into the pump or to restrict it to a suitable value, a device for generating a controlled leak flow is disposed at the shaft in the proximity of its entry into the pump. This device can, for example, be a slide ring seal with which, as is known, a direct physical contact is present between a part rotationally fixedly connected to the shaft and a part stationary with respect to the housing or it can be configured in the form of a restrictor with which there is no direct physical contact between rotating parts and stationary parts. This contactless restrictor device is a restrictor sleeve, for example.

Since, as already mentioned, such pump drive units have to be operated extremely reliably and free of maintenance, as a rule, over a longer period of time in permanent operation in many applications, extremely high importance is attached to the operating safety of the pump. It must in particular be ensured with aggressive fluids or process fluids harmful to the drive that the drive is sufficiently protected from the process fluid. This should also be the case when disturbances arise in the system. A possible and critical incidence is, for example, a disturbance in or a failure of the injection apparatus for the barrier fluid because there is the risk in this respect that too large an amount of process fluid penetrates into the drive and damages it. If the cooling circuit for the barrier fluid still works properly, the pump drive unit can admittedly in principle also still work without the injection apparatus, but only if no changes occur in the operating state of the pump drive unit or in the cooling system. A failure of or a disturbance in the barrier fluid injection therefore does not necessarily have to require a switching off of the pump drive unit. There is absolutely the possibility of continuing to operate the unit over at least a certain period of time and to remedy the disturbance at the injection apparatus during this period of time.

If there is, however, a reduction of the volume of the barrier fluid in the drive or in the cooling circuit on a failure of the injection system, the process fluid is so-to-say sucked into the drive and results in considerable damage there. In ebullating pumps in which the drive is typically arranged beneath the pump, this effect can be assisted by gravity. A volume reduction of the barrier fluid can have a plurality of causes in addition to unwanted leaks, e.g. in the lines. For example, the temperature of the cooling water, which is typically used for cooling the barrier fluid in the heat exchanger, can fall, whereby the barrier fluid cools and contracts due to thermal reasons. Or if the rotational speed of the pump is reduced, this also results in a volume reduction of the barrier fluid. Even if the pump drive unit has to be switched off, this ultimately results in a volume reduction of the barrier fluid. There is thus then the substantial risk that the drive is damaged or even irreparably destroyed by the process fluid.

The invention is directed to this problem. It is therefore an object of the invention to provide a pump drive unit for conveying a process fluid with which it is also ensured on a disturbance in the supply with barrier fluid that no damage arises to the drive by the process fluid. This pump drive unit should in particular also be able to be used as an ebullating pump.

The subject of the invention satisfying this object is characterized by the features described herein.

In accordance with the invention, a pump drive unit is therefore proposed for conveying a process fluid having a common housing which surrounds a pump having an impeller for rotation about an axial direction and a drive for the pump, having a shaft for driving the impeller which connects the drive to the pump, and having a restrictor which extends around the shaft and is arranged between the impeller and the drive, with the housing having a pump inlet and a pump outlet for the process fluid, with an inlet being provided for a barrier fluid through which the barrier fluid can be introduced into the drive and with an outlet being provided for the barrier fluid through which the barrier fluid can be drained from the housing, and with a plurality of storage chambers for the barrier fluid being disposed at the shaft in the region between the restrictor and the drive, said storage chambers are arranged behind one another with respect to the axial direction, with a respective two adjacent storage chambers being in flow communication with one another.

If an operating state now arises, for example due to a disturbance in the supply for the barrier fluid during which sufficient volume of barrier fluid is no longer disposed in the drive or in the housing to allow a flow of the barrier fluid through the restrictor into the pump, the process fluid starts to exit the pump along the shaft and moves through the restrictor and into the first of the storage chambers. Since the latter is still filled with the pure barrier fluid, a mixing of the process fluid with the barrier fluid arises here, whereby the process fluid is highly diluted. This mixture of process fluid and barrier fluid then moves as contaminated barrier fluid into the next storage chamber which is still filled with pure barrier fluid. The process fluid is then diluted even further by the pure barrier fluid in this storage chamber. In the last storage chamber, which is closest to the drive, the process fluid is then diluted the most. Even if the barrier fluid contaminated with process fluid should subsequently penetrate into the drive, the process fluid is diluted so much that no damage to the drive occurs.

On the occurrence of such a disturbance, during which sufficient volume of barrier fluid is no longer provided, there are then two possibilities. The first possibility is that the disturbance is so serious that it cannot be remedied in a short time. The pump drive unit then has to be switched off, with it being ensured by the design in accordance with the invention that only a small quantity—if any—of highly diluted process fluid can penetrate into the drive in the form of the contaminated barrier fluid on the switching off of the pump, which does not, however, result in any damage to the pump. A safe switching off of the pump drive unit is thus ensured without the drive being damaged by penetrating process fluid in this respect.

The second possibility is that the disturbance can be remedied in a relatively brief time. The pump drive unit does not have to be switched off in this case. As described above, on the occurrence of the disturbance, the process fluid is successively diluted in the storage chambers arranged behind one another in the axial direction. If the disturbance is now remedied, a sufficient quantity of pure barrier fluid is again provided. It then presses the contaminated barrier fluid out of the storage chambers in the direction of the pump so that contaminated barrier fluid is flushed out of the storage chambers into the pump. This also applies in an analogous same manner to the case that a specific quantity of barrier fluid contaminated with process fluid has already penetrated into the drive. This is then also drained out of the drive by the supply of the pure barrier fluid so that damage to the drive by the process fluid is effectively prevented.

It is thus ensured in every case that, on the occurrence of such a disturbance, damage to the drive by the process fluid is prevented, either by restarting the supply of pure barrier fluid or by a controlled and safe switching off of the pump drive unit.

A particular advantage of the design in accordance with the invention with the storage chambers can be seen in the fact that no seal arrangement at the shaft is required between the drive or the radial bearing provided at the drive at the pump side and the pump in which there is no direct physical contact between a rotating part—that is a part rotationally fixedly connected to the shaft—and a part stationary with respect to the housing, that is a slide ring seal, for example. The restrictor and the storage chambers work contactlessly in the sense that it does not touch the rotating shaft. This is in particular advantageous with such designs in which the process fluid is at a very high pressure, e.g. at least 200 bar, and/or has a very high temperature, e.g. at least 400° C. Slide ring seals are namely in particular problematic and less operationally safe in such applications, for example because a counter-pressure arises on a reduction of the volume of the barrier fluid in the drive which is applied over the slide ring seal. The contactless design in accordance with the invention is in contrast characterized by a higher operational safety and a smaller susceptibility to disturbance.

It is preferred for technical production reasons if each storage chamber is designed as an annular space about the axial direction.

In accordance with a preferred embodiment, two respective adjacent storage chambers are in flow communication through a restrictor gap, with the shaft respectively forming a boundary surface of the restrictor gap.

The suitable number of storage chambers naturally depends on the respective application or on the specific configuration of the pump drive unit, for example on the volume available for the barrier fluid in the drive, on the size and power of the pump or on the process fluid to be conveyed. It has proven successful in practice for at least three and at most ten storage chambers to be provided.

In a preferred embodiment, at least one of the storage chambers is disposed in the housing, for example as a ring-shaped groove which extends around the shaft.

Such embodiments are also possible in which at least one of the storage chambers is disposed in the shaft, for example as a ring-shaped groove which extends over the periphery of the shaft.

It is particularly preferred for technical production reasons for all the storage chambers to be disposed in the housing.

In a preferred embodiment, the outlet and the inlet for the barrier fluid are connected to one another by a line so that a cooling circuit is formed for the barrier fluid, with the cooling circuit comprising a heat exchanger.

To allow a configuration which is as compact and as simple as possible, it is advantageous for the heat exchanger for the cooling circuit to be installed at the housing. The heat exchanger can, for example, be fastened to the housing by a flange connection or by a screw connection.

In accordance with a preferred embodiment, an injection apparatus is provided for refilling barrier fluid.

A suitable dimensioning of the storage chambers naturally depends on the respective design of the pump drive unit and in particular on the volume available for the barrier fluid and therefore has to be determined for the specific application case. The storage chambers preferably have a total volume which is at least as large, and preferably twice as large, as the thermally caused volume change of the barrier fluid in the cooling circuit on a temperature reduction of the barrier fluid by a predefinable value. In the respective application case, that volume can therefore first be determined, for example, which is provided for the barrier fluid in the total cooling circuit, including the volume available in the drive. The temperature change is furthermore estimated which can typically occur in the operating state in the barrier fluid located in the cooling circuit. The volume change of the barrier fluid which is caused by such a temperature change can now be calculated for the barrier fluid used in the application case with the aid of the thermal coefficient of expansion. A value is then selected as the total volume of all the storage chambers which is at least as large and which is preferably twice as large as the determined volume change of the barrier fluid.

It is advantageous for many applications for the total volume of all the storage chambers to be at least 0.5% and at most 4%, preferably at most 3%, of the volume provided for the barrier fluid in the cooling circuit.

In a preferred embodiment, the housing is designed as a pressure housing, preferably for an operating pressure of at least 200 bar.

It is advantageous for a number of practical applications for the pump drive unit to be designed for a process fluid which has a temperature of more than 400° C.

The design in accordance with the invention is in particular suitable for such a pump drive unit in which the drive is arranged beneath the pump with respect to the vertical or is arranged next to the pump with respect to the horizontal. With respect to the normal position of use of the pump drive unit, this means that the pump is arranged above or next to the drive in the common housing.

An embodiment particularly important for practice is when the pump drive unit is designed as an ebullating pump for the circulation of a process fluid.

Further advantageous measures and embodiments of the invention result from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
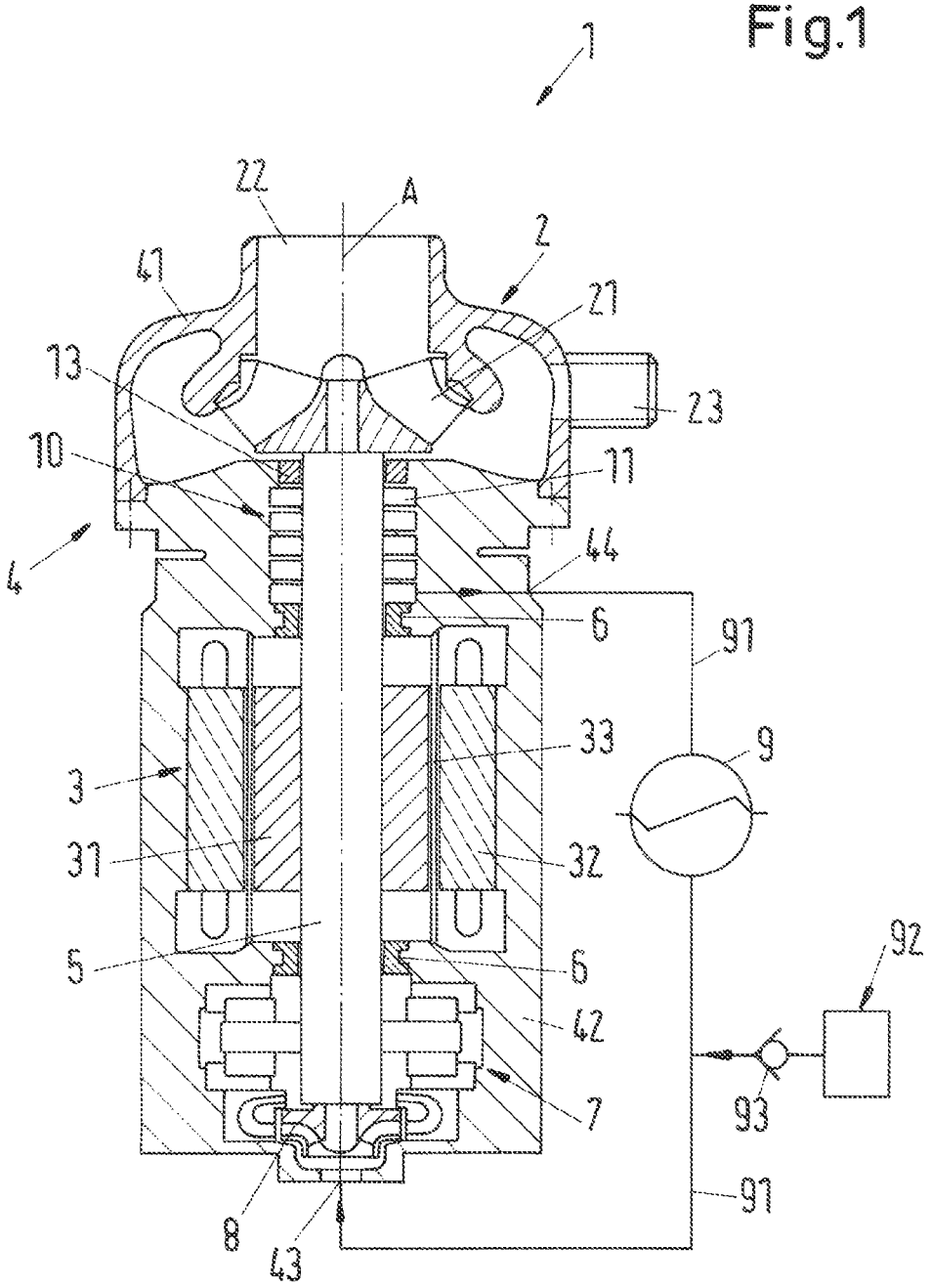
FIG. 1 is a partly schematic sectional representation of an embodiment of a pump drive unit in accordance with the invention.

FIG. 1 shows in a partly schematic sectional representation an embodiment of a pump drive unit in accordance with the invention for conveying a process fluid which is designated as a whole by the reference numeral 1. The pump drive unit 1 comprises a pump 2, which is designed as a centrifugal pump and a drive, which is designed as an electric motor. The pump 2 and the drive 3 are arranged in a common housing 4 which surrounds the drive 3 and the pump 2. The housing 4 comprises an upper housing part 41 as well as a lower housing part 42 which are sealingly connected to one another by screw connections, not shown, or by a flange connection.

The pump drive unit 1 in this embodiment is specifically designed as an ebullating pump. As initially mentioned, ebullating pumps are pump drive units which are used for fluidized bed processes or ebullated bed processes in the hydrocarbon processing industry. These processes are used to purify, for example to desulfurize, heavy hydrocarbons which remain, for example, in the petroleum refinery in the bottom of the dividing columns and/or to break them down into lighter hydrocarbons which can then be used more economically as distillates. Heavy duty oil which remains in the refining of petroleum can be named as an example for heavy hydrocarbons here. In a known process, the starting substance, that is the heavy hydrocarbons such as heavy fuel oil, is heated, is mixed with hydrogen and is then supplied as process fluid into the fluidized bed reactor or ebullated bed reactor. The purification or breaking down of the process fluid then takes place in the reactor with the aid of catalysts which are held in suspension in the reactor to ensure a contact which is as intimate as possible with the process fluid. An ebullating pump which is typically installed directly at the reactor is used for the supply of the reactor with the process fluid or for the circulation of the process fluid.

Since the process fluid is at a very high pressure of, for example, at least 200 bar and at a very high temperature of, for example, more than 400° C. due to the process, the ebullating pump also has to be designed for such pressures and temperatures. In this respect, the housing 4 of the ebullating pump 1 designed as a pump drive unit, which housing surrounds the pump 2 and the drive 3, is designed as a pressure housing which can safely withstand these high operating pressure of, for example, 200 bar or more. In addition, the ebullating pump is also designed such that it can convey a hot process fluid without risk which has a temperature of more than 400° C.

Reference is therefore made with exemplary character in the following to the application case important for practice that the pump drive unit 1 is designed as such an ebullating pump. It is, however, understood that the invention is not restricted to such embodiments or applications. The pump drive unit 1 in accordance with the invention can also be designed for other applications, for example as a submersible pump which is completely or partly submerged in a liquid, e.g. water, during operation. The invention is in particular suitable for those pump drive units in which the drive 3 is arranged beneath the pump 2 with respect to the vertical (vertical pump) or in which the drive 3 is arranged next to the pump 2 with respect to the horizontal (horizontal pump). A representation of an embodiment as a horizontal pump in this respect corresponds e.g. to a representation which results by a rotation of FIG. 1 by 90°.

In the embodiment of the pump drive unit 1 in accordance with the invention as an ebullating pump shown in FIG. 1, the pump 2 is arranged above the drive 3 with respect to the normal position of use which is shown in FIG. 1. The pump 2 is designed as a centrifugal pump with an impeller 21 which has a plurality of vanes and which rotates about an axial direction A in the operating state. The housing 4 has a pump inlet 22 which is here arranged above the impeller 21 as well as a pump outlet 23 which is here arranged laterally at the housing 4. The impeller 21 conveys the process fluid, that is here the fluid with the heavy hydrocarbons, e.g. heavy fuel oil, from the pump inlet 22 to the pump outlet 23 which is directly connected to the reactor.

The drive 3 is provided for driving the impeller 21 and is here designed in a manner known per se as an electric canned motor. The drive 3 comprises an inwardly disposed rotor 31 as well as an outwardly disposed stator 32 surrounding the rotor 31. A can 33 is provided between the rotor 31 and the stator 32 and seals the stator hermetically in a known manner with respect to the rotor 31. The rotor 31 is rotationally fixedly connected to a shaft 5 which extends in the axial direction A and which is connected, on the other hand, rotationally fixedly to the impeller 21 of the pump 2 so that the pump 2 can be driven by the drive 3.

A respective radial bearing 6 is provided for the radial support of the shaft 5 directly above and directly beneath the driver 3 with respect to the axial direction A. An axial bearing 7 for the shaft 5 is disposed beneath the radial bearing 6 at the bottom in accordance with the representation. Furthermore, a circulation impeller 8 for a barrier fluid is provided at the lower end of the shaft 5 in accordance with the representation; it is likewise rotationally fixedly connected to the shaft 5 and is designed as a radial impeller. Its function will be explained further below. The circulation impeller 8 can also be provided between the pump 2 and the drive 3 on the shaft 5.

The pump 2 conveys the process fluid from the pump inlet 22 to the pump outlet 23 during the operation of the pump. In the case of heavy hydrocarbons such as heavy fuel oil as the process fluid, but also with other process fluids, for example chemically aggressive substances or contaminated fluids, it is necessary to take measures against the process fluid penetrating, or at least against it penetrating in a harmful quantity, into the drive 3. Such a penetration would be possible, for example, if the process fluid exits the pump 2 along the shaft 5 and as a consequence penetrates into the drive 3 along the shaft 5. For this reason, a barrier fluid is provided, for example an oil, in particular a lubricating oil or cooling oil whose one function it is to prevent the penetration of process fluid into the drive 3. In addition, the barrier fluid also satisfies the function as a cooling fluid of dissipating heat and of lubricating the drive 3 as well as the radial bearings 6 and the axial bearing 7 as a lubricant. The heat to be dissipated from the barrier fluid comprises both the heat which is generated by the drive 3 during its operation and that heat which is transferred from the hot process fluid to the shaft 5 or to the housing 4. Whereas the process pressure in the drive 3 and in the pump 2 is substantially the same, the operating temperature in the pump 2 is considerably higher than in the drive 3. Whereas, for example, the impeller 21 substantially adopts the same temperature as the process fluid, that is here above 400° C., for example, the temperature in the drive 3 is much lower, for example in the region of 60° C. The barrier fluid thus also has the function of dissipating the heat transferred from the hot impeller 21 to the shaft 5.

Both an inlet 43 for the barrier fluid through which the barrier fluid can be introduced into the drive 3 and an outlet 44 for the barrier fluid through which the barrier fluid can be drained from the housing 4 are provided at the housing 4 for the supply with the barrier fluid. As shown in FIG. 1, the outlet 44 is preferably in flow communication with the inlet 43 so that the barrier fluid is conducted in a cooling circuit. This cooling circuit furthermore comprises a heat exchanger 9 which is provided outside the housing 4 and in which the barrier fluid outputs its heat to a heat transfer medium, for example to water.

The inlet 43 for the barrier fluid is provided in accordance with the representation at the lower end of the housing 4 so that the barrier fluid not only flows through the drive 3, but also through the two radial bearings 6 as well as through the axial bearing 7, whereby they are lubricated and cooled. Above the upper radial bearing 6 in accordance with the representation, the barrier fluid is then conducted to the outlet 44 and moves via the line 91 to the heat exchanger 9 where the barrier fluid outputs heat. The barrier fluid is then conducted from the heat exchanger 9 back through the line 91 to the inlet 43, whereby the cooling circuit is completed.

The already mentioned circulation impeller 8 which is driven by the shaft 5 serves to circulate the barrier fluid through the cooling circuit. The inlet 43 is arranged opposite the circulation impeller 8 so that the circulation fluid 8 sucks the barrier fluid through the inlet 43 in the axial direction A. The barrier fluid conveyed by the circulation impeller 8 flows through the axial bearing 7 and through the lower radial bearing 6, is then introduced into the drive 3, flows through the gap there between the rotor 31 and the can 33, exits the drive 3, flows through the upper radial bearing 6 and is then conducted to the outlet 44 from where the barrier fluid is circulated through the line 91 and the heat exchanger 9 back to the inlet 44.

The penetration of process fluid into the bearings 6 and 7 and in particular into the drive 3 is prevented by the barrier fluid circulating in the cooling circuit since the flowing barrier fluid blocks the passage for the process fluid along the shaft 5 into the drive 3.

To further increase the operating safety of the pump drive unit 1 and, for example, to compensate volume fluctuations of the barrier fluid in the cooling circuit, an injection apparatus 92 is furthermore provided for refilling or for feeding barrier fluid into the cooling circuit. The injection apparatus 92, which is not shown in detail, comprises a source or a storage container for the barrier fluid and is connected to the cooling circuit via a check valve 93. It is possible in this respect—as shown in FIG. 1—that the injection apparatus 92 is connected to the part of the cooling circuit arranged outside the housing 4, that is, for example, to the line 91, or a separate inlet opening is provided at the housing 4 through which the barrier fluid can be introduced into the cooling circuit by the injection apparatus 92.

During the normal, i.e. problem-free operation of the pump drive unit 1, the injection apparatus 92 is used to compensate a wanted and controlled leak flow of the barrier fluid along the shaft 5 into the pump 2. The barrier fluid exiting the drive 34 and flowing through the upper radial bearing 6 is not completely drained through the outlet 44. Some of the barrier fluid generates a leak flow along the shaft 5 into the pump 2 and mixes there with the process fluid, which does not, however, have any negative effects. It is efficiently prevented by this leak flow into the pump 2 that process fluid can flow in the reverse direction along the shaft 5 out of the pump 2. The quantity of barrier fluid required for this leak flow is continuously supplied to the cooling circuit by the injection apparatus 92, i.e. in normal operation the injection apparatus 92 replaces the quantity of barrier fluid which is introduced into the process fluid by the leak flow. The injection apparatus 92 furthermore compensates volume changes of the barrier fluid located in the cooling circuit. Such volume changes can occur, for example, on changes of the speed of the pump 2 or on temperature changes or during the starting up or the switching off of the pump drive unit 1.

The leak flow is typically not particularly strong and amounts, for example, to approximately 20 to 30 liters an hour in normal operation.

If a disturbance now occurs in the injection apparatus 92 or in the injection system for the barrier fluid, for example if there is a failure of the injection apparatus 92 so that the injection apparatus 92 cannot resupply any barrier fluid or only insufficient barrier fluid into the cooling circuit, this does not inevitably produce the danger that the drive 3 is damaged by penetrating process fluid because sufficient barrier fluid is still circulated in the cooling circuit to keep the process fluid away from the drive 3.

If there is now additionally a volume reduction of the barrier fluid located in the cooling circuit during such a disturbance of the injection apparatus 92, a state can occur in which there is no longer sufficient volume of barrier fluid available in the drive 3 or in the housing 4 to prevent a flow of the process fluid along the shaft 5 out of the pump 2 in the direction of the drive 3. Such a volume reduction can have a plurality of causes. For example, the temperature of the heat transfer medium, e.g. cooling water, to which the barrier fluid outputs heat in the heat exchanger 9 can fall or the speed, i.e. the rotary speed, of the pump 2 falls, or the pump drive unit 1 is switched off.

Figure 2:
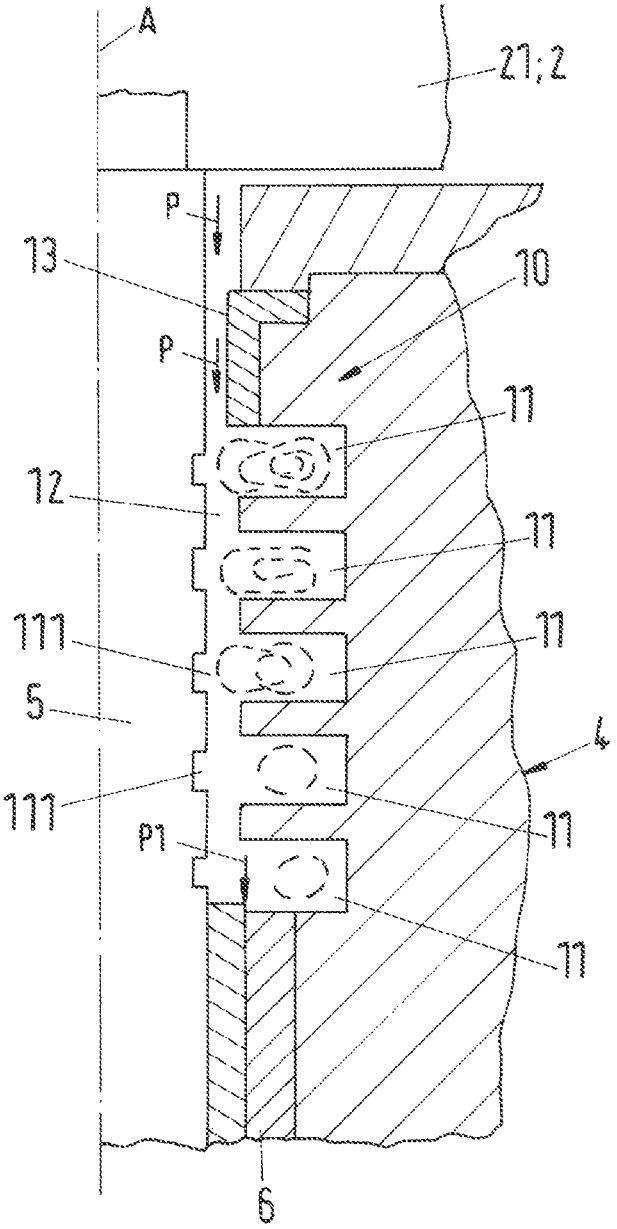
FIG. 2 is an enlarged sectional representation of the restrictor and the storage chambers of the embodiment of FIG. 1 at the shaft between the drive and the pump.

In order also to protect the drive 3 sufficiently against a penetration of process fluid in those states in which there is a volume reduction of the barrier fluid located in the cooling circuit, in accordance with the invention a combination is provided at the shaft 5 in the region between the pump 2 and the drive 3 and is designated as a whole by the reference numeral 10 and comprises a restrictor 13 and a plurality of storage chambers 11. FIG. 2 shows an enlarged sectional representation of this combination 10 of the embodiment of FIG. 1. The combination 10 comprises a plurality of storage chambers 11, five here, for the barrier fluid which are arranged behind one another with respect to the axial direction A, with two respective adjacent storage chambers 11 being in flow communication. This flow communication is preferably configured as a restriction gap 12, as shown in FIG. 2, with the shaft 5 respectively forming a boundary surface of the restriction gap 12. The restriction gap is only characterized by the reference numeral 12 for the two storage chambers 11 at the top in accordance with the representation in FIG. 2. The other storage chambers 11 are naturally also in flow communication through such a restriction gap 12.

The restrictor 13 which is here configured as a restrictor sleeve 13 which extends about the shaft 5 in a manner known per se without contacting the shaft 5 in so doing is arranged between that storage chamber 11 which Is closest to the pump 2 or to the impeller 21, that is the topmost storage chamber 11 in accordance with the representation, and to the impeller 21 of the pump 2. The restrictor sleeve 13 is arranged or installed as stationary with respect to the housing 4. The restrictor sleeve 13 is configured such that it limits the volume flow of the barrier fluid into the pump 2 to a controlled leak flow in normal, i.e. problem-free operation of the pump drive unit 1. It is understood that the configuration of the restrictor as a restrictor sleeve 13 is only to be understood by way of example. Every apparatus known per se with which a controlled leak flow of the barrier fluid can be generated in a contact-free manner is suitable as the restrictor 13. For example, the surface of the restrictor 13 which faces towards the shaft 5 can be smooth or unstructured. Also it is possible, that the restrictor 13 is configured as a labyrinth restrictor 13 which has in a known manner several grooves and bars on its surface which faces towards the shaft 5, whereby said grooves and bars form a comb like profile, which is commonly called a labyrinth.

The five storage chambers 11 (see FIG. 2) are here each configured as annular spaces which extend around the shaft 5. In this respect, all the storage chambers 11 are provided in the housing 4 or in a component which is stationary with respect to the housing and which surrounds the shaft 5. The storage chambers 11 can, for example, be produced by cutting machining processes in the housing 4.

In the embodiment shown in FIG. 2, all five storage chambers 11 have the same volume; the total volume of all the storage chambers 11 is thus five times the volume of one storage chamber 11. It is understood that it is not necessary that all the storage chambers 11 have the same volume; it is by all means possible to configure the storage chambers 11 with different volumes.

In normal, problem-free operation of the pump drive unit 1, as already described, the barrier fluid is circulated in the cooling circuit by the circulation impeller 8, with the return of the barrier fluid to the outlet 44 taking place, for example—as shown schematically in FIG. 1—out of that storage chamber 11 which is closest to the drive 3. It is, however, also possible to provide the return at a different point, for example between the drive 3 and the storage chamber 11 disposed closest to it.

The barrier fluid is, however, not returned fully through the outlet 44, but there is a controlled leak flow of the barrier fluid from the drive 3 through the five storage chambers 11 and the restrictor sleeve 13 into the pump 2. This leak flow reliably prevents process fluid from being able to flow in the reverse direction from the pump 2 along the shaft 5 in the direction of the drive. The volume of barrier liquid which is introduced by the controlled leak flow into the pump 2 and thus into the process fluid is lost for the cooling circuit, but is replaced by the injection apparatus 92 with new barrier fluid which is introduced into the cooling circuit.

If, as already described, there is now a disturbance in the resupply of the barrier fluid, for example a failure of the injection apparatus 92, so that no barrier fluid or insufficient barrier fluid can be resupplied and there is then a state which does not produce any volume reduction of the barrier fluid in the cooling circuit, the configuration with the storage chambers 11 for the barrier fluid in accordance with the invention protects the drive 3 in a sufficient manner from a penetration of the barrier, as will be explained in the following with reference to FIG. 2.

A failure of the resupply of barrier fluid in conjunction with a volume reduction of the barrier fluid in the cooling circuit has the result that the process fluid can now exit the pump 2 along the shaft 5 or is sucked out in the direction of the drive 3 depending on the circumstances. This is indicated in FIG. 2 by the arrows having the reference symbol P. The process fluid then first moves into the first storage chamber 11 which is closest to the pump 2. This storage chamber 11, like all the other storage chambers 11, too, is still filled with a pure barrier fluid, which is stored there. As a result, there is a mixing of the process fluid with the barrier fluid in this first storage chamber 11, whereby the process fluid is highly diluted. The process fluid is shown symbolically in FIG. 2 by the small dashes (without reference numerals) in the storage chambers 11. The now already considerably diluted process fluid moves via the restrictor gap 12 into the next storage chamber 11 which is initially still completely filled with pure barrier fluid. In this storage chamber 11, the already diluted process fluid is diluted even further by the barrier fluid before this further diluted mixture can advance via the next restrictor gap 12 into the adjacent storage chamber 11. This process is continued up to and into that storage chamber 11 which is closest to the drive 3. The process fluid is diluted the most in this last storage chamber 11 before the drive 3. The highly diluted process fluid can only move through the radial bearing 6 into the drive 3 from this last chamber 11 as is indicated in FIG. 2 by the arrow having the reference symbol P1.

The process fluid in the last storage chamber 11 before the drive 3, which can optionally advance into the drive 3, is already diluted so much by this mixing with the pure barrier fluid that it can initially not cause any damage to the drive 3.

To effect a mixing of the process fluid with the barrier fluid which is as good as possible in the storage chambers 11, it can be advantageous to configure the flow path for the process fluid through the combination 10 with further measures such that eddies occur to promote the mixing of the process fluid with the barrier fluid present in the storage chambers 11. In the embodiment in accordance with FIG. 2, a plurality of annular grooves 111 are disposed in the shaft 5 for this reason of which each is arranged opposite one of the storage chambers 11.

If now the disturbance in the refilling of the barrier fluid into the cooling circuit is remedied, that is, for example, if the injection apparatus 92 is again working properly, the barrier fluid contaminated with the process fluid is urged by the newly supplied barrier fluid both out of the drive 3 (if it has advanced up to it) and successively out of the storage chambers 11 and is conveyed into the pump 2. After this flushing of the drive 3 and of the storage chambers 11, the drive 3 and the storage chambers 11 are then again filled with pure barrier fluid so that normal operation can be continued.

An effective protection of the drive is naturally dependent on the duration of the disturbance in the redelivery of barrier fluid into the cooling circuit. If it takes too long until this disturbance is remedied, or if, for example, an unwanted leak in the cooling circuit occurs due to damaged lines or leaking connection points, the configuration in accordance with the invention still makes it possible that the pump drive unit can be switched off without there being any risk that process fluid can penetrate into the drive in a quantity damaging for the drive 3 during the switching off process.

Figure 5:
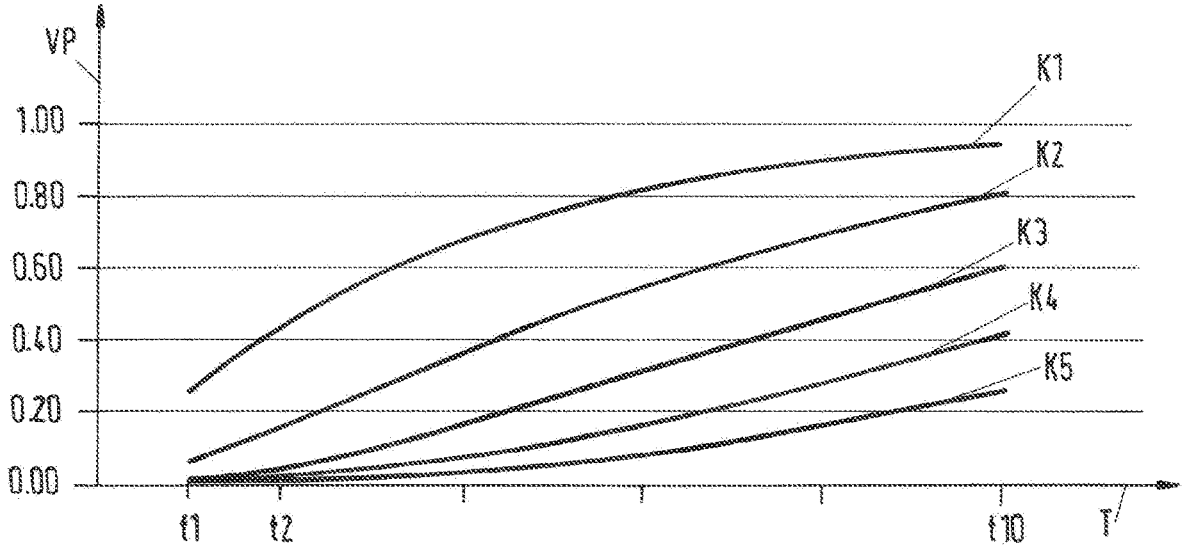
FIG. 5 is a diagram to illustrate the concentration of the process fluid in the storage chambers on the occurrence of a disturbance.

FIG. 5 illustrates the operation of the embodiment in accordance with the invention of the combination 10 with the storage chambers 11 on the occurrence of a disturbance. In the specific case shown in FIG. 5, the disturbance comprises the injection apparatus failing so that new barrier fluid can no longer be introduced into the cooling circuit. In addition, a cooling of the barrier fluid by 10K occurs in the cooling circuit, for example by a reduction of the speed of the drive 3 and/or by a temperature change in the heat transfer medium, e.g. cooling water, of the heat exchanger 9. The five storage chambers 11 (see FIG. 2) have a total volume which amounts to approximately 1.3% of the volume of the cooling circuit, with the volume of the cooling circuit being composed of the volume available to the barrier fluid in the drive 3 and of the volumes in the heat exchanger 9, the line 91 as well as in all the connections between the inlet 43 and the outlet 44. An oil is used as the barrier fluid which has a thermal coefficient of expansion with respect to the volume of $0.7 \cdot 10^{-3}$/K.

The diagram in FIG. 5 shows the time development of the relative volume VP of the process fluid for the five storage chambers 11 (see FIG. 2). The time T is entered on the horizontal axis and the relative volume VP of the process fluid in one of the storage chambers 11 on the vertical axis. The curve K1 shows the relative volume VP for the first storage chamber 11 which is the storage chamber 11 which is closest to the pump 2 or to the impeller 21. This is the topmost storage chamber 11 in accordance with the representation in FIG. 2. The curves K2, K3, K4, K5 show in an analog manner the relative volume of the process fluid in the adjacent storage chambers 11, with the numbering of the storage chambers 11 corresponding to the order shown in FIG. 2. I.e. the curve K2 indicates the relative volume VP of the process fluid in the second storage chamber 11 which is arranged directly adjacent to the first storage chamber 11, etc. Accordingly, the curve K5 indicates the relative volume VP of the process fluid in that storage chamber 11 which is closest to the drive 3.

On the time axis, t1 indicates the time at which the process fluid starts to enter into the first storage chamber on the occurrence of the above-described disturbance, i.e. shortly before the time t1 all five storage chambers 11 are still just filled with pure barrier fluid. From the time t1 onward, the process fluid advances into the first storage chamber 11 at a constant flow rate. This flow rate is approximately such that a quantity of process fluid enters into the first storage chamber 11 per time interval t2–t1 which corresponds to approximately a quarter of the volume of the first storage chamber 11.

The diagram in FIG. 5 clearly illustrates the increasing dilution effect from storage chamber to storage chamber which results by the mixing of the process fluid with the barrier fluid. At a time t10, in accordance with the curve K1, the relative volume portion of the process fluid in the first storage chamber 11 has already increased to more than 90%, whereas in accordance with the curve K5, the relative volume portion of the process fluid in the last storage chamber 11 is only at approximately a quarter, that is approximately 25%.

It is thus ensured that over a longer time period, if at all, only highly diluted process fluid can advance into the drive 3, which typically does not result in damage to the drive 3.

A particular advantage of the embodiment in accordance with the invention is in this respect that no seal arrangement is required between the drive 3 or the upper radial bearing 6 and the pump 2 which is based on a direct physical contact between rotating parts and stationary parts. It is here therefore in particular also possible to dispense with slide ring seals which have specifically proved to be problematic and prone to disturbance at high temperatures and/or at high process pressures.

Two variants for the embodiment of the storage chambers 11 will still be described in the following with reference to FIG. 3 and FIG. 4. In this respect, only the differences from the embodiment shown in FIG. 2 will be looked at. All previous explanations also apply in an analog same manner to these two variants.

Figure 3:
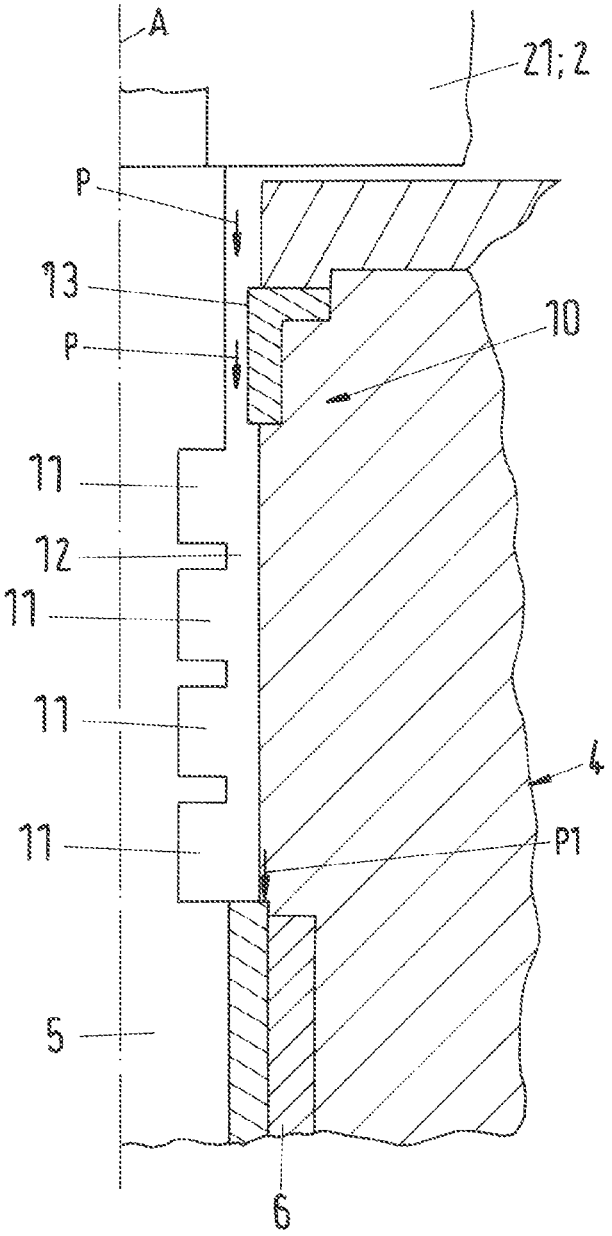
FIG. 3 is as FIG. 2, but for a first variant of the restrictor device.

In the first variant shown in FIG. 3, a total of four storage chambers 11 are arranged behind one another with respect to the axial direction of which each is configured as an annular space around the axial direction A. All the storage chambers 11 are disposed in the shaft 5 in this embodiment.

Figure 4:
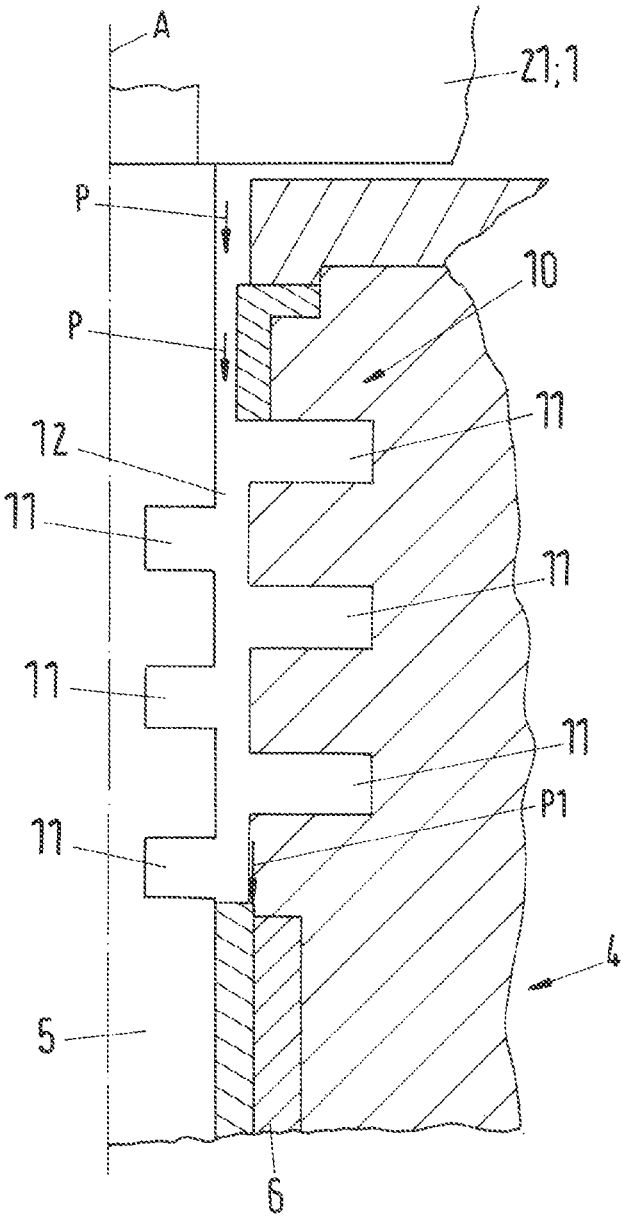
FIG. 4 is as FIG. 2, but for a second variant of the restrictor device.

In the second variant shown in FIG. 4, a total of six storage chambers 11 are arranged behind one another with respect to the axial direction of which each is configured as an annular space around the axial direction A. The storage chambers 11 in this embodiment are provided alternately in the housing 4 or in a part stationary with respect to the housing and in the shaft 5. In this respect, the storage chambers 11 disposed in the housing 4 have different volumes, here a larger volume than disposed in the shaft 5.

The embodiments of the combination 10 with the restrictor 13 and the storage chambers 11 shown in FIGS. 2-4 are naturally only to be understood as exemplary. Numerous modifications are possible here of which only some will be mentioned in the following.

The storage chambers 11 configured as annular spaces in the shaft 5 or in the housing 4 are each shown in FIGS. 2-4 with a rectangular cross-section in a section along the axial direction A. This cross-section can naturally also have different shapes, for example the cross-section can be U-shaped or V-shaped.

The storage chambers 11 can also be configured as sector-like cut-outs in the housing 4 and/or in the shaft, i.e. the storage chambers 11 do not have to extend over the total periphery around the shaft 5.

The volumes of the individual storage chambers 11 can also differ (see e.g. FIG. 3); also the volumes of those storage chambers 11 which are arranged in the housing 4 or of those storage chambers 11 which are arranged in the shaft.

A suitable choice of the number of storage chambers 11 depends on the respective application. It is advantageous for a large number of embodiments for at least three storage chambers 11 and at most ten storage chambers 11 to be provided.

The total volume of all the storage chambers 11 can also be adapted to the respective application. As already mentioned, an advantageous total volume of the storage chambers 11 can be determined with reference to the volume reduction of the barrier fluid in the cooling circuit to be expected in operation or in the disturbance case. It has proven to be advantageous for a large number of applications for the total volume of all the storage chambers 11 to be at least 0.5%, and at most 4%, preferably at most 3%, and specifically at most 2%, of the volume available for the barrier fluid in the cooling circuit.

The invention claimed is:

1. A pump for conveying a process fluid, comprising:

a pump having an impeller rotatable about an axial direction;

a drive for the pump, the drive having a shaft configured to drive the impeller, and which connects the drive to the pump;

a restrictor extending around the shaft and being arranged between the impeller and the drive;

a housing having a pump inlet and a pump outlet for the process fluid, a barrier inlet for introduction of a barrier fluid into the drive and a barrier outlet for drainage of the barrier fluid from the housing; and a plurality of storage chambers for the barrier fluid provided at the shaft in a region between the restrictor and the drive, the storage chambers being arranged behind one another with respect to the axial direction, with two adjacent storage chambers of the plurality of storage chambers being in flow communication with one another, the barrier outlet and the barrier inlet being in flow communication with one another through a line so as to form a cooling circuit for the barrier fluid, with the cooling circuit comprising a heat exchanger, and the plurality of storage chambers having a total volume which is at least as large as a thermally induced volume change of the barrier fluid in the cooling circuit based on an estimated temperature change of the barrier fluid.

2. A pump drive unit in accordance with claim 1, wherein each storage chamber of the plurality of storage chambers is configured as a ring space about the axial direction.

3. A pump drive unit in accordance with claim 1, wherein the two adjacent storage chambers are in flow communication through a restrictor gap, with the shaft forming a boundary surface of the restrictor gap.

4. A pump drive unit in accordance with claim 1, wherein the plurality of storage chambers includes between three and ten storage chambers.

5. A pump drive unit in accordance with claim 1, wherein at least one of the storage chambers is in the housing.

6. A pump drive unit in accordance with claim 1, wherein at least one of the storage chambers is in the shaft.

7. A pump drive unit in accordance with claim 1, wherein each of the storage chambers is in the housing.

8. A pump drive unit in accordance with claim 1, further comprising an injection apparatus configured to refill the barrier fluid.

9. A pump drive unit in accordance with claim 1, wherein the total volume of the plurality of storage chambers is at least 0.5% and at most 4% of a volume available for the barrier fluid in the cooling circuit.

10. A pump drive unit in accordance with claim 1, wherein the housing is a pressure housing.

11. A pump drive unit in accordance with claim 1, wherein the pump drive is configured to circulate a process fluid having a temperature of more than 400° C.

12. A pump drive unit in accordance with claim 1, wherein the drive is arranged beneath the pump with respect to a vertical.

13. A pump drive unit in accordance with claim 1, wherein the pump drive unit is an ebullating pump configured to circulate a process fluid.

14. A pump drive unit in accordance with claim 1, wherein the total volume of the plurality of storage chambers is 3% of a volume available for the barrier fluid in the cooling circuit.

15. A pump drive unit in accordance with claim 1, wherein the housing is a pressure housing for an operating pressure of at least 200 bar.

16. A pump drive unit in accordance with claim 1, wherein the drive is arranged next to the pump with respect to a horizontal.

17. A pump drive unit in accordance with claim 1, wherein the barrier inlet is arranged along the axial direction.

18. A pump drive unit for conveying a process fluid, comprising:

a pump having an impeller rotatable about an axial direction;

a drive for the pump, the drive having a shaft configured to drive the impeller, and which connects the drive to the pump;

a restrictor extending around the shaft and being arranged between the impeller and the drive;

a housing having a pump inlet and a pump outlet for the process fluid, a barrier inlet for introduction of a barrier fluid into the drive and a barrier outlet for drainage of the barrier fluid from the housing; and a plurality of storage chambers for the barrier fluid provided at the shaft in a region between the restrictor and the drive, the storage chambers being arranged behind one another with respect to the axial direction, with two adjacent storage chambers of the plurality of storage chambers being in flow communication with one another, the barrier outlet and the barrier inlet being in flow communication with one another through a line so as to form a cooling circuit for the barrier fluid, with the cooling circuit comprising a heat exchanger, and the plurality of storage chambers having a total volume which is twice as large as a thermally induced volume change of the barrier fluid in the cooling circuit based on an estimated temperature change of the barrier fluid.

* * * * *